US011299890B2

(12) United States Patent
Passon et al.

(10) Patent No.: US 11,299,890 B2
(45) Date of Patent: Apr. 12, 2022

(54) REAR-VENTILATED BUILDING FACADE AS WELL AS PROCESS FOR MANUFACTURING SAME

(71) Applicant: SAINT-GOBAIN ISOVER, Courbevoie (FR)

(72) Inventors: Ulrich Passon, Karlsruhe (DE); Wilhelm Gröner, Schriesheim (DE); Walter Schüller, Groß-Rohrheim (DE)

(73) Assignee: SAINT-GOBAIN ISOVER, Courbevoie (FR)

( * ) Notice: Subject to any disclaimer, the term of this patent is extended or adjusted under 35 U.S.C. 154(b) by 0 days.

(21) Appl. No.: 16/977,743

(22) PCT Filed: Jan. 9, 2019

(86) PCT No.: PCT/EP2019/050419
§ 371 (c)(1),
(2) Date: Sep. 2, 2020

(87) PCT Pub. No.: WO2019/174792
PCT Pub. Date: Sep. 19, 2019

(65) Prior Publication Data

US 2020/0392738 A1 Dec. 17, 2020

(30) Foreign Application Priority Data

Mar. 16, 2018 (DE) ..... 10 2018 106 183.8

(51) Int. Cl.
*E04F 13/00* (2006.01)
*E04B 1/74* (2006.01)
(Continued)

(52) U.S. Cl.
CPC ..... *E04F 13/007* (2013.01); *E04B 1/74* (2013.01); *E04B 1/88* (2013.01); *E04B 1/947* (2013.01);
(Continued)

(58) Field of Classification Search
CPC . E04F 13/0835; E04F 13/0875; E04F 13/007; E04F 2290/047; E04F 2290/045; E04B 1/88; E04B 1/947; E04B 2001/742
See application file for complete search history.

(56) References Cited

U.S. PATENT DOCUMENTS 4,857,364 A * 8/1989 von Bonin ..... C08G 18/0885 427/254
5,402,615 A * 4/1995 Knott ..... B32B 15/02 52/309.1
(Continued)

FOREIGN PATENT DOCUMENTS

AT 381527 B * 10/1986 ..... E04F 13/007
CA 2572708 C * 8/2014 ..... E04F 17/00
(Continued)

OTHER PUBLICATIONS

Passon et al., Rear-Ventilated Building Facade as Well as Process for Manufacturing Same, Office Action from Japanese Patent Office dated Oct. 28, 2021, Japanese Patent Application No. P2020-548903.
(Continued)

*Primary Examiner* — Babajide A Demuren
(74) *Attorney, Agent, or Firm* — Schmeiser, Olsen & Watts LLP

(57) ABSTRACT

The present invention pertains to a rear-ventilated building facade with a load-bearing external wall, with an insulation layer formed from insulation panels and with a facade cladding, wherein the facade cladding is installed by means of a load-bearing structure, forming a rear ventilation gap, at a spaced location from the insulation layer, and wherein the rear ventilation gap is interrupted in the vertical direction by at least one fire barrier, which is configured as a mineral wool panel. It is characterized in that the at least one fire barrier extends over the entire width of the rear ventilation
(Continued)

gap, and that the at least one fire barrier has at least one opening extending in the vertical direction in the area of the rear ventilation gap. The present invention further provides a process for manufacturing a rear-ventilated building facade. It is thus possible to perfect a rear-ventilated building facade of this class such that a lastingly reliable fire protection can be achieved with a cost-effective configuration.

20 Claims, 3 Drawing Sheets

(51) Int. Cl.
*E04B 1/88* (2006.01)
*E04B 1/94* (2006.01)
*E04F 13/08* (2006.01)

(52) U.S. Cl.
CPC ..... *E04F 13/0835* (2013.01); *E04F 13/0875* (2013.01); *E04B 2001/742* (2013.01); *E04F 2290/047* (2013.01)

(56) References Cited

U.S. PATENT DOCUMENTS

| | | | | |
|---|---|---|---|---|
| 10,196,812 | B1 * | 2/2019 | Duffy | E04F 13/06 |
| 2013/0291465 | A1 * | 11/2013 | Resso | E04F 13/0805 52/302.1 |
| 2015/0013257 | A1 | 1/2015 | Power et al. | |
| 2015/0059260 | A1 * | 3/2015 | Kallweit | E04B 1/947 52/99 |

FOREIGN PATENT DOCUMENTS

| | | | | |
|---|---|---|---|---|
| CA | 2983319 | A1 * | 5/2018 | E04D 13/17 |
| DE | 1985851 | | 5/1968 | |
| DE | 4036865 | | 5/1992 | |
| DE | 202019101487 | U1 * | 4/2019 | E04F 13/007 |
| EP | 0208650 | | 1/1987 | |
| GB | 2296263 | | 6/1996 | |
| JP | 08135038 | | 5/1996 | |
| JP | 2004052245 | | 2/2004 | |
| KR | 20120139936 | | 12/2012 | |
| KR | 20160069632 | | 6/2016 | |

OTHER PUBLICATIONS

Passon et al., Rear-Ventilated Building Facade As Well As Process for Manufacturing Same, ntemational Preliminary Report on Patentability, Patent Cooperation Treaty Application No. PCT/EP2019/050419, filed Jan. 9, 2019.

Passon et al., Rear-Ventilated Building Facade as Well as Process for Manufacturing Same, Office Action from Korean Patent Office dated Dec. 20, 2021, Korean Patent Application No. 1020207025812.

Passon et al., Rear-Ventilated Building Facade as Well as Process for Manufacturing Same, Office Action from Eurasian Patent Office dated Nov. 18, 2021, Eurasian Patent Application No. 202092192.

* cited by examiner

REAR-VENTILATED BUILDING FACADE AS WELL AS PROCESS FOR MANUFACTURING SAME

BACKGROUND OF THE INVENTION

The present invention pertains to a rear-ventilated building facade with a load-bearing external wall, with an insulation layer formed from insulation panels and with a facade cladding, wherein the insulation layer is fastened to the external wall, wherein the facade cladding is arranged by means of a load-bearing structure, forming a rear ventilation gap at a spaced location from the insulation layer, and wherein the rear ventilation gap is interrupted in the vertical direction by at least one fire barrier, which is configured as a mineral wool panel. The present invention further pertains to a rear-ventilated building facade.

Various structures for designing building facades are known from practice. A variant used especially in commercial buildings is represented by so-called rear-ventilated curtain facades, which possess especially good protection function for the load-bearing wall cladded therewith as well as concerning the design possibilities.

Such rear-ventilated external wall claddings are arranged on a load-bearing wall and comprise the facade cladding, a load-bearing structure, which holds the facade cladding, forming a rear ventilation gap, as well as optionally a thermal insulation layer, which is fastened to the load-bearing external wall. The facade cladding has open or closed joints, mutually overlapping elements or the like. The load-bearing structure consists, as a rule, of metal, but it may also be made of wood or the like. It typically comprises horizontally or vertically extending bearing rails, which are connected to the building wall. The thermal insulation layer may consist of a foamed plastic, bound mineral wool or other known insulating materials. The rear ventilation gap is formed here between the outer side of the thermal insulation layer and the facade cladding.

Since the insulation and the facade cladding are structurally separated from one another in this wall configuration, the wall and the insulation are protected from moisture, heat, cold, wind, etc. In addition, there is a space, in which moisture that may be present can be reliably removed, is present due to the rear ventilation gap. At the same time, the thermal insulation layer has no load-bearing function beyond it is own load, and it can therefore be optimized concerning the thermal and/or sound insulation.

Optical aspects are also associated with the above-described technical advantages of a rear-ventilated facade. The facade cladding is formed, as a rule, from individually, flexurally rigid panel elements, such as highly compacted mineral fiber panels, metal panels or the like. These are reliably connected to the load-bearing structure, for example, by screw connection, bonding or riveting. However, this connection may also be established by the load-bearing structure extending behind the edges of the cladding panels in a positive-locking manner. It is therefore possible to individually coordinate the external appearance of the facade cladding with the character and the particular architectural style of the building. This is, as a rule, especially desirable precisely in case of commercial buildings, but in high-rise buildings or the like as well.

However, the drawback of such rear-ventilated facades is that the rear ventilation gap may act as a kind of chimney when a fire develops on the facade (stack-effect). Attention is therefore paid to fire protection in such types of construction.

Corresponding to the technical building codes of the Deutsches Institut für Bautechnik (German Institute for Structural Engineering), horizontal fire barriers are to be arranged in the rear ventilation gap in every other floor. These are to be installed, as a rule, between the wall and the facade cladding. Installation between the insulation layer and the facade cladding is sufficient in case of a thermal insulation located on the outside if the insulating material is dimensionally stable in case of a fire and has a melting point higher than 1,000° C. If the load-bearing structure consists of combustible building materials, it must be completely interrupted in the area of the horizontal fire barriers. This is, however, also advantageous in case of load-bearing structures consisting of, for example, metal, and this corresponds to the usual practice, in order to avoid stresses in the system based on longitudinal thermal expansions of the different components.

The fire barriers reduce the cross-sectional area of the rear ventilation gaps in the vertical direction and are used to prevent the flames from spreading in this direction. At the same time, they do not, however, close the rear ventilation gap completely in order to continue to allow ventilation of the air and hence the removal of moisture.

The fire barriers must have sufficient dimensional stability over at least 30 minutes, and the installation of a steel plate with a thickness of >1 mm is therefore proposed by the technical building codes. This steel plate may partially cover the rear ventilation gap and thus leave a residual gap for the rear ventilation, or it may also extend completely over the rear ventilation gap, in which case it may, however, be perforated. The size of the residual gap or of the openings is to be limited in this case to a total of 100 cm2/linear meter (Model Administrative Provisions—Technical Building Rules (MVV TB) Annex 6, 4.3)

DIN 18516-1:2010-06 in section 4.2 on the other hand sets a lower limit of the size of the residual gap or of the openings to be at least a total of 50 cm2/linear meter to comply with air ventilation requirements.

An example of such a fire barrier can be found in the document DE 20 2012 100 418 U1. A blocking element consisting of fiber material, such as glass wool or mineral wool is provided as a fire barrier in this prior-art rear-ventilated facade. This blocking element extends over the surface of the insulation layer in the direction of the facade cladding and leaves a residual gap to this as a ventilation gap. The blocking element has a compressible and/or flexible configuration and is under prestress in the normal case. This enables the blocking element to close the residual gap in case of fire. It has a two-part configuration for this, for example, by means of a spacer element, which maintains the fiber material under pressure for a long time. If, however, a fire develops, the spacer element burns and/or melts and releases the fiber material. This material decompresses and completely closes the gap to the facade cladding and thus the rear ventilation gap.

However, this type of configuration of a fire barrier requires reliable resilience of the fiber material for a fiber barrier over a long time if the compression is eliminated. This is, however, hardly possible in practice. Should a fire develop at the building, this may also happen only after 20 or 30 years. It is questionable whether a sufficient prestress is still present in the fiber material, even and precisely under the effects of weather for the rear ventilation gap to be able to be closed reliably. Moreover, the construction of these prior-art fire barriers is complicated and expensive.

EP 3 181 778 A1 shows a rear-ventilated building facade. Fire barriers are arranged between vertically adjacent panels forming a facade cladding. Ventilation channels within the fire barriers correspond to ventilation channels of the facade cladding. An effective fire barrier, therefore, is not provided as such a fire barrier does not prevent the stack-effect.

The basic object of the present invention is therefore to improve a rear-ventilated building facade of this class such that long-lasting fire protection can be achieved with a cost-effective configuration.

This object is accomplished by a rear-ventilated building facade having the features of claim 1. This facade is characterized in that the at least one fire barrier extends over the entire depth of the rear ventilation gap and that the at least one fire barrier has at least one opening extending in the vertical direction in the area of the rear ventilation gap.

The present invention thus rejects the construction principle of the pertinent state of the art and abandons any kind of expansion or stress relief motion of the material of the fire barrier. Aging processes of the fiber material therefore play no role according to the present invention for the establishment and maintenance of the fire protection.

It is essential for this that the at least one fire barrier extends according to the present invention over the entire depth of the rear ventilation gap from the start and thus closes this per se. Accordingly, it does not have to first reach this position in case of fire but is already in that position from the start. However, ventilation of the air in the rear ventilation gap is nevertheless possible through the at least one opening extending in the vertical direction in the fire barrier.

It was recognized in this connection according to the present invention that the at least one such opening provided in the fire barrier is perfectly sufficient, on the one hand, to ensure sufficient ventilation, but, on the other hand, it does sufficiently prevent the spread of fire. The flames can thus be prevented from spreading at the fire barrier and sufficient fire protection can be achieved. Practical tests carried out in the course of the invention have confirmed this.

Another advantage is that the fire barrier consisting of mineral wool can have according to the present invention a simple panel-like configuration and can therefore be provided as well as installed on the building facade in a very cost-effective manner.

Even though the technical building codes of the Deutsches Institut für Bautechnik propose the use of a fire barrier with uniformly distributed individual openings, what is meant hereby is, however, a perforated steel plate with a thickness in the mm range rather than a fire barrier configured as a mineral wool panel. The individual holes in the conventional steel plate therefore lack, from a practical point of view, a technically relevant depth, as a result of which a fire can definitely spread through these very well. The fire barrier consisting of a mineral wool panel, which is provided according to the present invention, has, by contrast, a certain panel thickness owing to its construction. The individual openings are not therefore holes without an extension in depth, but they are a type of channels, which considerably prevent flames from spreading.

Advantageous variants of the rear-ventilated building facade according to the present invention are the subject of the dependent claims 2 through 13.

Thus, the fire barrier can have uniformly distributed openings in the form of holes. The rear ventilation gap contains in this manner a sufficient ventilation area in order for a reliable removal of moisture to be possible during normal use. The rear-ventilated building facade according to the present invention can thus reliably assume the rear ventilation function over a along time and is therefore characterized by a long service life. Moreover, such uniformly distributed holes can be prepared in the fire barrier without problems and in a cost-effective manner by milling, punching or the like.

A sum of areas of the openings per linear/running meter may be equal to or less than 80 cm2, preferably equal to or less than 70 cm2. Further, the sum of areas of the openings per linear/running meter may be not less than 60 cm2. A test has proven that this value further improves the fire protection provided by the present invention.

It is also possible, as an alternative or in addition, that the fire barrier has a thickness between 2 cm and 10 cm. A mineral wool panel having such dimensions can be manufactured, handled and installed on the building facade in a simple manner. At the same time, the openings thus have a sufficient depth to reliably prevent flames from spreading. In a preferred type of configuration, the fire barrier has a thickness of 3 cm to 5 cm, by means of which the fire protection required in practice can be reliably achieved in most cases.

Further, it proved to be advantageous if the fire barrier has an apparent density between 60 kg/m3 and 300 kg/m3. A fire barrier thus configured has sufficient intrinsic stability to be able to act as a fire barrier; moreover, it has a suitable resistance to the effect of fires, so that it is resistant over a sufficiently long time. The fire barrier preferably has here an apparent density between 80 kg/m3 and 200 kg/m3. It is found to be especially suitable in this range for the intended use. It is particularly preferred if the fire barrier has an apparent density of 100 kg/m3 to 150 kg/cm3.

It is possible in another type of configuration that the fire barrier extends from the facade cladding into the insulation layer. The fire barrier now can be fastened in a simple and cost-effective manner, e.g., by clamping. It was further shown in practical tests that it is often unnecessary to pass the fire barrier completely through the insulation layer. It is therefore sufficient, especially in case of great insulation thicknesses, to insert the fire barrier into the insulation layer only to the extent that the fire barrier maintains its position for a long time. The installation of the fire barrier can be made especially simple in this manner. In a preferred variant, the fire barrier does, however, extend from the facade cladding to the external wall. It is held there especially reliably in this case and may also be fastened to the external wall by bonding. In addition, the fire barrier now advantageously pierces the insulation layer, which is usually less fire resistant. The fire protection effect of the fire barrier improves considerably even more as a result. The building facade as a whole can thus be classified to a higher fire classification.

Another advantage is that the mineral wool of the fire barrier has a laminar fiber structure in relation to the large surface of the fire barrier. The fibers are now at right angles to the wall, which is advantageous in respect to the stability of the fire barrier, even though it is disadvantageous in respect to the thermal insulation effect. The dimensional stability and the fire protection effect of the fire barrier can thus be ensured for a long time. This orientation of the fibers leads to better thermal insulation in case of a fire towards elements of the rear-ventilated facade arranged above the fire barrier; furthermore, the fire barrier is better protected from possible weather effects in the rear ventilation gap.

It is further possible that the fire barrier has an intumescent coating. This coating expands considerably under thermal effect, as a result of which the protection effect of the fire barrier is improved even more in case of a fire. In particular, flames can be prevented from spreading hereby even more reliably, because possibly remaining free spaces due to the unevennesses or the like can close reliably and completely at the interface towards the facade cladding. It is, further, also possible to arrange the coating such that the at least one opening in the fire barrier becomes partially or fully closed. The building facade according to the present invention can thus be provided with a considerably improved fire protection effect.

If the insulation panels of the insulation layer are made of mineral wool, especially good fire protection properties can be achieved. Further, good thermal and sound insulation properties can be achieved as well.

Tests have shown that it is preferred to arrange the fire barrier in every floor of the building as opposed to the technical building codes of the Deutsches Institut für Bautechnik.

Usually the insulation layer is formed form a plurality of facade insulation panels. In such case the fire barriers may be arranged, preferably clamped, between two vertically adjacent facade insulation panels. This is a very easy and efficient process to install the fire barrier. This may be even more improved by securing at least the facade insulation panels of a layer of facade insulation panels directly above the fire barriers vertically slidably to the external wall. For installing the fire barriers these facade insulation panels are shifted upwards, then the fire barriers are inserted and finally the facade insulation panels are moved down again, especially so that the fire barriers are clamped between the vertically adjacent facade insulation panels.

According to another aspect of the present invention, a process is provided according to claim 14 for manufacturing a rear-ventilated building facade configured especially according to the present invention. This is characterized by the steps of fastening a load-bearing structure on a load-bearing external wall, fastening an insulation layer formed from insulation panels to the external wall, forming at least one slot in the insulation layer, insertion of at least one fire barrier configured as a mineral wool panel into the gap, and fastening of a facade cladding to the load-bearing structure such that the facade cladding is arranged at a spaced location from the insulation layer, forming a rear ventilation gap, wherein the at least one fire barrier extends over the entire depth of the rear ventilation gap, and wherein the at least one fire barrier has an opening, which extends in the vertical direction and which comes to lie in the area of the rear ventilation gap.

A rear-ventilated building facade can be manufactured by this process especially cost-effectively, simply and rapidly. At the same time, it is characterized by especially good fire resistance while the rear ventilation function continues to be suitable.

Advantageous variants of the process according to the present invention are the subject of the dependent claims 15 through 18.

Thus, the slot in the insulation layer may be formed by incising the flatly laid insulation layer. The installation of the insulation layer is separated according to the present invention from the installation of the fire barrier. It is thus possible to place the insulation layer on the external wall over the full surface in a first step and to avoid time-consuming cutting of the individual insulation panels to the extent possible. The slot is then incorporated at the suitable location in the insulation layer, for example, by means of a knife, a saw or the like. The insulation material is preferably removed in the area of the slot in order to facilitate the insertion of the fire barrier. This procedure make sit possible to carry out the installation especially simply and rapidly.

It is, however, also possible as an alternative to lay the insulation panels of the insulation layers at spaced locations from one another such that the slot between vertically adjacent insulation panels is obtained. The subsequent creation of the slot by incision made in the insulation layer can thus be eliminated.

Further, it is advantageous if the at least one fire barrier is inserted into the associated slot by a predetermined extent. It is not necessary in this case to pass the slot through the entire thickness of the insulation layer, which leads to a further simplification of the installation. It is, however, also possible in a preferred embodiment that the fire barrier is inserted through the entire insulation layer up to the external wall. The fire barrier can now be held especially reliably in the insulation layer. Further, the insulation layer is completely interrupted in this case, which is advantageous concerning the fire protection effect, because the insulation panels of the insulation layer are typically optimized in respect to the thermal and/or sound insulation, but not in respect to fire protection.

If the fire barrier is pressed into the slot or the fire barriers are clamped between two vertically adjacent facade insulation panels, especially reliable holding of the fire barrier on the building facade can be achieved. The reliability and durability of the facade increases considerably as a result.

BRIEF DESCRIPTION OF THE DRAWINGS

The present invention will be explained in more detail below on the basis of the drawing figures. In the drawings.

DETAILED DESCRIPTION OF EMBODIMENTS OF THE INVENTION

Figure 1:
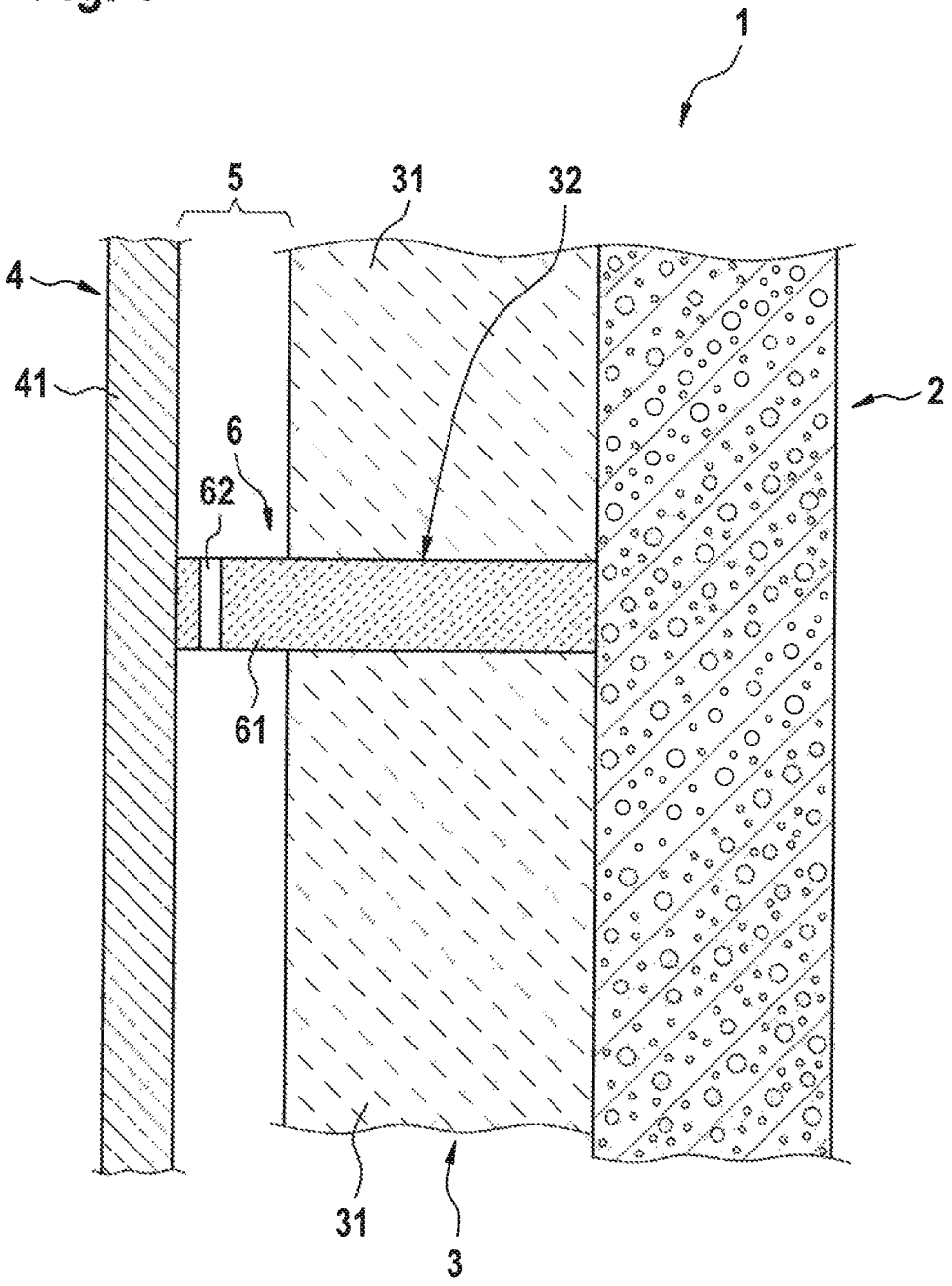
FIG. 1 shows a schematic lateral view of a rear-ventilated building facade according to a first embodiment of the present invention.

According to the view in FIG. 1, a building facade 1 has a load-bearing external wall 2. An insulation layer 3 is fastened by means of adhesive and/or dowel on the outer side of the external wall 2 in a manner that is conventional per se. Further, the building facade 1 has a load-bearing structure made of metal, which is not shown for the sake of simplifying the view and which is fixed on the external wall 2. The load-bearing structure holds a facade cladding 4, forming a rear ventilation gap 5 between the insulation layer 3 and the facade cladding 4 at the external wall 2.

The insulation layer 3 is constructed from a plurality of insulation panels 31, which possess good thermal insulation properties. For example, facade insulation panels with a thermal conductivity WLG035 are suitable for this. These have a very low thermal conductivity and therefore great thermal insulation and offer good fire protection. An incombustible insulation panel, Euro Class A1, with a melting point of >1,000° C. and an apparent density of about 25 kg/m3 is used in the exemplary embodiment.

Figure 2:
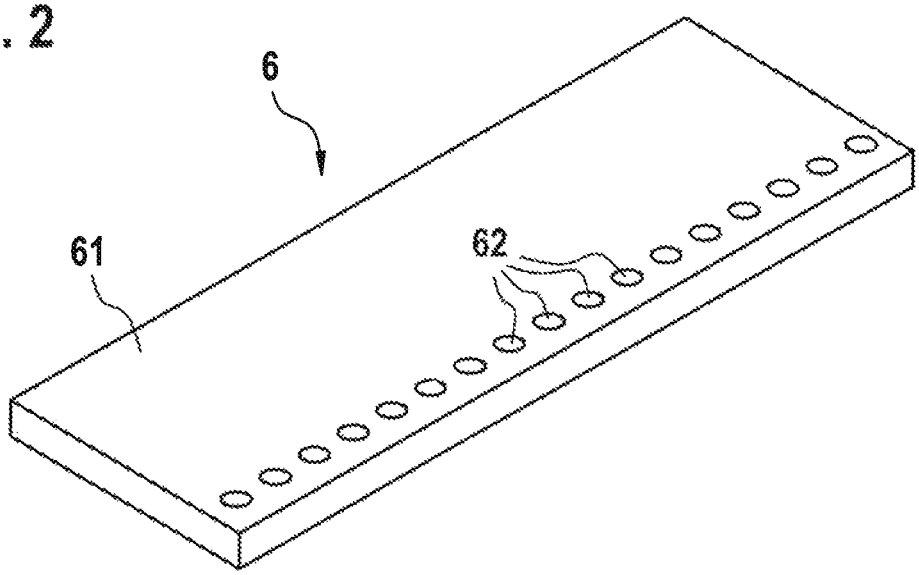
FIG. 2 shows a perspective view of a fire barrier according to the first embodiment.

Further, the building facade 1 has a plurality of fire barriers 6, which are configured as mineral wool panels and which are used as a horizontal fire barrier in the rear ventilation gap and one of which is shown in more detail in FIG. 2. These fire barriers 6 are arranged in every other floor of the building as a horizontal fire barrier in the rear ventilation gap 5 in accordance with the technical building codes of the Deutsches Institut für Bautechnik. However, tests have shown that the fire barriers 6 are preferably arranged in every floor of the building.

An incombustible (Euro Class A1) mineral wool insulation panel with laminar fiber orientation, with a melting point of >1,000° C. and an apparent density of about 140 kg/m3 is used as a fire barrier 6 in this exemplary embodiment. The thickness of the panel is about 3 cm.

The fire barrier 6 has a blocking body 61, which extends from the external wall 2 to the facade cladding 4 and thus interrupts the insulation layer 3. The fire barrier 6 is received clampingly in a slot 32 of the insulation layer 3 in the exemplary embodiment shown. The end of the blocking body 61 facing the external wall 2 is bonded to this wall and is thus fixed thereto. With the outside end, the blocking body 61 of the fire barrier 6 is in contact with the facade cladding 4 such that no gap is essentially formed there. The blocking body 61 has a laminar fiber structure, as a result of which the fibers are essentially at right angles to the external wall 2.

In the area of the rear ventilation gap 5, the fire barrier 6 has a plurality of uniformly distributed openings in the form of holes 62, which allow the passage of air in the rear ventilation gap 5. The holes 62 extend for this through the entire thickness of the blocking body 61 and thus connect the spaces above and below same. The size of all openings present in the fire barrier 6 due to the holes 62 is limited to 100 cm2 per linear meter. More preferably, the size of the openings is limited to 80 cm2, in particular 70 cm2 per linear meter. On the other hand, the size of all openings should preferably be greater than 60 cm2 per linear meter. In a test, excellent results are achieved with the size of all openings of 60 cm2 per linear/running meter.

The facade cladding 4 has a plurality of cover panels 41, which have a flexurally rigid configuration and are fixed one by one on the load-bearing structure. Fiber cement panels were used as cover panels 41 in the practical test.

This configuration was subjected to a practical test, which was successful, in the course of the present invention. The fire barriers 6 prevented the spread of fire or the jumping over of the fire after the end of the test over the required time period of 30 minutes. It was seen, in particular, that the energy sent through the holes 62 did not suffice to cause the fire to spread.

Figure 3:
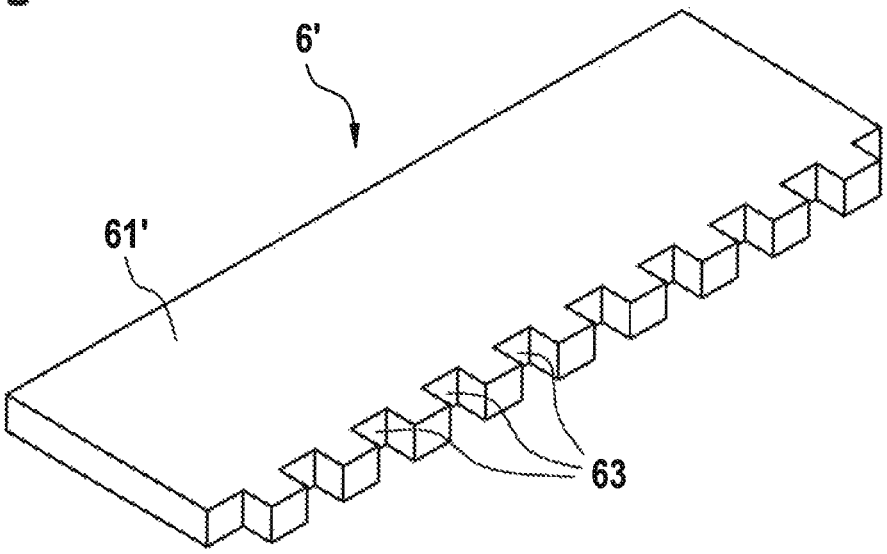
FIG. 3 shows a perspective view of a fire barrier according to a second embodiment.

FIG. 3 shows another embodiment of a fire barrier, which is designated by the reference number 6'. This differs from the fire barrier according to the first embodiment in the configuration of the blocking body 61' and of the openings.

As is seen in the view shown in FIG. 3, the openings are configured in the form of regular recesses 63 located at the edge. This leads to a crenellated structure at the lateral edge of the fire barrier 6', which edge faces the facade cladding 4.

Figure 4:
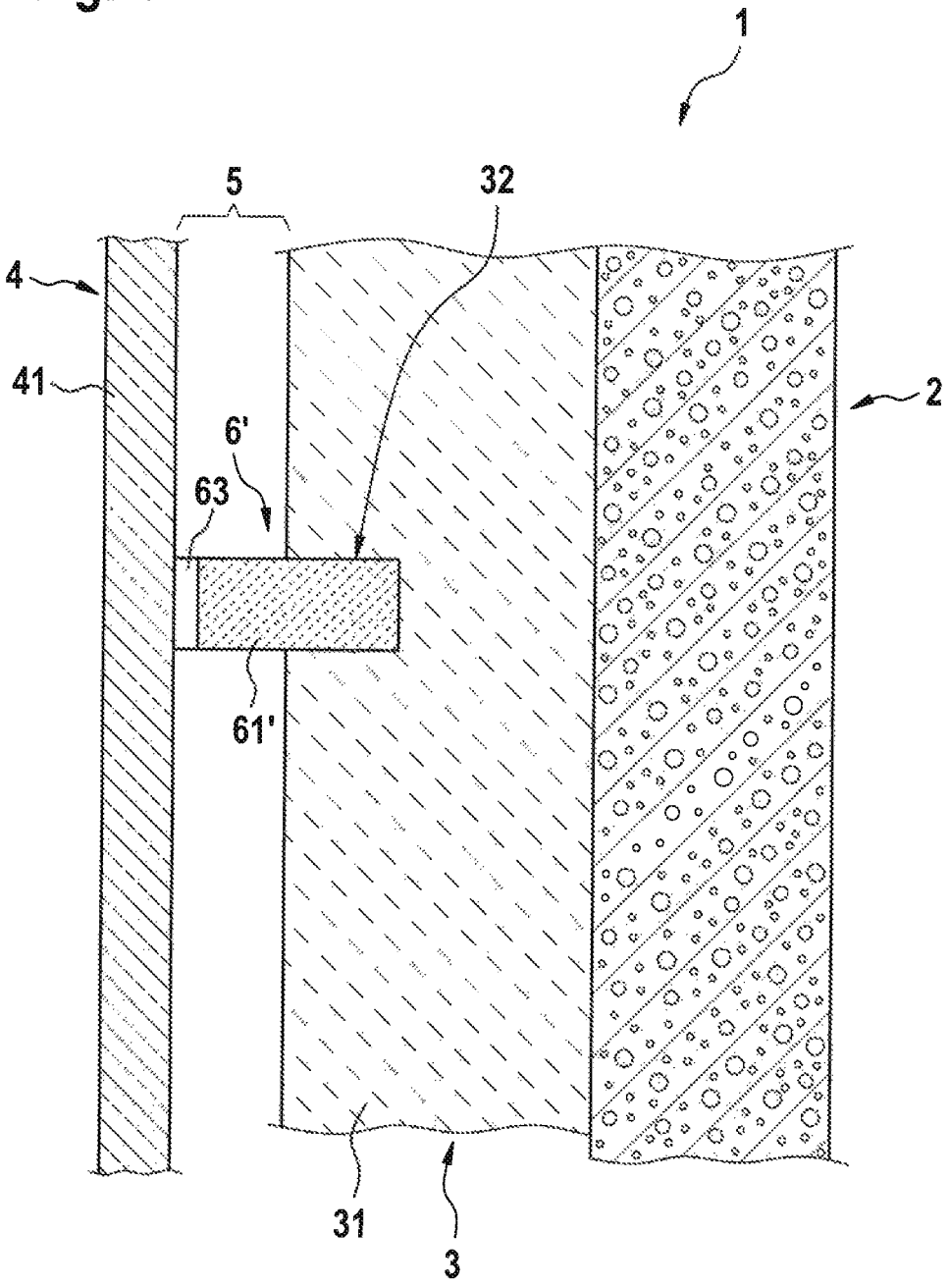
FIG. 4 shows a schematic lateral view of a rear-ventilated building facade according to the present invention according to another embodiment.

FIG. 4 shows a schematic lateral view of another embodiment of the rear-ventilated building facade 1.

This differs from the above-described embodiment, on the one hand, in that the fire barrier 6' just explained is used with a crenellated edge side. Moreover, the fire barrier 6' does not pass completely through the insulation layer 3 but extends into same to a predetermined extent only, here over about ⅓ of the overall thickness of the insulation layer 3. The slot 32 was formed for this in advance with the desired depth in the insulation layer 3, and the fire barrier 6' was finally inserted into this slot under pressure. It is thus held clampingly in the insulation layer 3.

The slot 32 was not formed at right angles to the large surface of the insulation layer 3 but sloped by a few degrees relative thereto. As a result, the fire barrier 6' is positioned obliquely in relation to the insulation layer 3 such that it hangs somewhat outwardly away from the insulation layer 3 and thus guides water away from the insulation layer 3 if necessary.

A process for manufacturing the rear-ventilated building facade 1 will be explained below.

The load-bearing structure is first fastened here to the bearing external wall 2. This is carried out in the usual manner by means of screws and dowels. The insulation layer 3 is then built up on the external wall 2, for which the insulation panels 31 are bonded on and/or fixed by means of dowels one after another to form a closed insulation surface. The elements of the load-bearing structure are correspondingly recessed at the locations at which the insulation layer 3 is interrupted by elements of the load-bearing structure.

The slots 32 are finally inserted at the predetermined locations into the insulation layer 3 by means of a knife or the like. Two incisions are concretely made now in the insulation layer 3 at spaced locations from one another and the insulation material located between them is subsequently removed.

The fire barriers 6 and 6' can then be inserted into the slots 32, because this is carried out under pressure and clamping of the fire barriers 6 and 6' in the insulation layer 3 is thus achieved.

The depth of the slots 32 prepared can be adapted to the particular application. It may be limited, as is shown in FIG. 4. It may, however, also pass completely through the insulation layer 3, as this is shown in FIG. 1. Also, the slot 32 may be formed between two vertically adjacent facade insulation panels 31. In such case the fire barriers 6 are arranged, preferably clamped, between the two vertically adjacent facade insulation panels 31. At least the facade insulation panels 31 of a layer of facade insulation panels 31 directly above the fire barriers 6 and 6' may be vertically slidably secured to the external wall 2. For installing the fire barriers 6 and 6' the upper layer of facade insulation panels 31 are shifted upwards to form the slot 32, then the fire barriers 6 and 6' are inserted into the slot and finally the facade insulation panels 31 are moved down again, especially so that the fire barriers 6 are clamped between the vertically adjacent facade insulation panels 31.

It is essential that the fire barriers 6 and 6' extend over the entire depth of the rear ventilation gap 5. Further, the fire barriers 6 and 6' have, in the area of the rear ventilation gap 5, uniformly distributed holes 62 or regular recesses 63 located at the edge, as they can be seen in FIGS. 2 and 3.

Finally, the facade cladding 4 is installed on the load-bearing structure such that it is located at a spaced location from the insulation layer 3, forming the rear ventilation gap 5. The fire barriers 6 and 6' are now in contact with the facade cladding.

The rear-ventilated building facade is thus finished.

The rear-ventilated building facade 1 according to the present invention further allows the additional configuration principles explained below.

Thus, it is not necessary for the openings to be present in a uniformly distributed manner at the fire barrier 6. They may also be formed irregularly or mixed in the form of holes 62 and in the form of recesses 63 located at the edge.

The recesses 63 do not have to have the rectangular shape shown in FIG. 3; they may also have a triangular, semicircular or another suitable geometry.

It is equally unnecessary for the holes 62 to have a round shape; they may also have a different cross-sectional shape and be configured as elongated holes.

In the type of configuration explained, the fire barrier 6 has a thickness of about 3 cm, but this is not necessary; depending on the application, it may also have a thinner or thicker configuration. Material thicknesses between 2 cm and 10 cm have proved to be especially suitable in this connection.

A mineral wool panel suitable for the application, which is different from the one explained, may also be used for the fire barrier 6 insofar as this possesses suitable fire protection properties.

Thus, the apparent density of the fire barrier 6 may also have a value different from the value of 140 kg/m3 as explained. A mineral wool panel with apparent densities between 60 kg/m3 and 200 kg/m3 is preferably used, and even fire barriers 6 with an apparent density of 80 kg/m3 may be sufficient for some applications. It is also possible to use heavier fire barriers 6 with an apparent density of, for example, 300 kg/m3, depending on the particular requirements.

Moreover, it is also unnecessary for the fire barriers 6 and 6' to be pressed into the insulation layer 3. They may also be arranged herein, for example, with a clearance and fastened by an adhesive or the like.

It is also not necessary in this connection for the fire barrier 6 to be fixed on the external wall 2 by, for example, bonding. For example, the clamping effect between the facade insulation panels 31 of the insulation layer may thus also be sufficient to ensure sufficient stability of the fire barriers 6. As an alternative, the fire barrier 6 may also be fixed mechanically, e.g., by means of suitable fastening components, profiles or the like.

Further, it is also unnecessary for the fire barrier 6 to consist of mineral wool. An especially fireproof glass wool or even slag wool or the like may also be used for this.

The mineral wool of the fire barrier 6 does not, moreover, need to have a laminar fiber structure. This mineral wool may also be different, so that it is possible to use especially compressed fiberboards.

Further, it is possible that the fire barrier 6 additionally has an intumescent coating. This leads to a further increase in the fire protection effect. In addition to or instead of the intumescent coating, it is also possible to take other fire-retardant measures, such as the use of dehydrating additives or the like.

It is further possible that the fire barrier 6 additionally has a coating intended for weather protection in order to protect especially the fire barrier 6 from water entering into the rear ventilation gap 5.

If the insulation layer 3 has a sufficient fire protection effect, it may also be sufficient if the fire barrier 6 extends only from the outer side of the insulation layer 3 to the facade cladding 4.

The fire barrier 6 may be manufactured in the factory with an oversize, in which case it is then cut to the corresponding dimension between the external wall 2 and the facade cladding 4 at the time of the installation on the building facade 1 according to the present invention. It is unnecessary in this case to manufacture special custom-made fire barriers 6 in advance. In addition, adaptation to the special on-site conditions is possible without problems.

It is not necessary for the slot 32 to be formed in the insulation layer 3 by being cut into this layer. The insulation panels 31 may, instead, also be positioned on the external wall 2 in the course of the installation such that the slot 32 is obtained as a free space between these at the predetermined locations.

If, however, the slot 32 is cut into the insulation layer 3, its depth is to be selected in a suitable manner depending on the conditions prevailing at the concrete building.

It is not absolutely necessary in some applications for the insulation material to be removed from the slot 32. It can possibly be displaced when the fire barrier 6 or 6' is being pressed in.

As an alternative, the slot 32 may also be formed in one operation by milling the material out of the insulation layer 3.

The facade insulation panels 31 of the insulation layer 3 may also be formed from a material other than the mineral wool mentioned above. It is thus possible to use other suitable insulating fiberboards or insulation panels consisting of an incombustible material.

The invention claimed is:

1. Rear-ventilated building facade (1) comprising:

a load-bearing external wall (2), an insulation layer (3) formed from insulation panels (31) and fastened to the external wall (2), a facade cladding (4) installed by means of a load-bearing structure forming a rear ventilation gap (5) at a spaced location from the insulation layer (3), and at least one fire barrier (6, 6') configured as a mineral wool panel and interrupting the rear ventilation gap (5) in the vertical direction, wherein the fire barrier (6, 6') extends over the entire depth of the rear ventilation gap (5), characterized in that the at least one fire barrier (6, 6') has at least one opening (62,63) extending in the vertical direction in the area of the rear ventilation gap (5) wherein a sum of areas of the at least one opening (62, 63) per linear meter equals to or is less than 100 $cm^2$.

2. Building facade in accordance with claim 1, characterized in that the fire barrier (6) has uniformly distributed openings in the form of holes (62).

3. Building facade in accordance with claim 1, characterized in that the fire barrier (6') has openings in the form of regular recesses (63) arranged at the edge.

4. Building facade in accordance with claim 1, characterized in that a sum of areas of the openings per linear meter equals to or is less than 80 $cm^2$; and/or the sum of areas of the openings per linear meter is not less than 60 $cm^2$.

5. Building facade in accordance with claim 1, characterized in that the fire barrier (6) has a thickness between about 2 cm and about 10 cm.

6. Building facade in accordance with claim 1, characterized in that the fire barrier (6, 6') has an apparent density between about 60 $kg/m^3$ and about 300 $kg/m^3$.

7. Building facade in accordance with claim 1, characterized in that the fire barrier (6, 6') extends from the facade cladding (4) into the insulation layer (3), wherein the fire barrier (6, 6') extends from the facade cladding (4) through the insulation layer (3) to the external wall (2).

8. Building facade in accordance with claim 1, characterized in that the mineral wool of the fire barrier (6, 6') has a laminar fiber structure.

9. Building facade in accordance with claim 1, characterized in that the fire barrier (6, 6') has an intumescent coating.

10. Building facade in accordance with claim 1, characterized in that the insulation panels (31) of the insulation layer (3) are formed from mineral wool.

11. Process for manufacturing a rear-ventilated building facade in accordance with claim 1, characterized by the steps:

fastening of a load-bearing structure to a load-bearing external wall (2), fastening of an insulation layer (3) formed from insulation panels (31) to the external wall (2), formation of at least one slot (32) in the insulation layer (3), insertion of at least one fire barrier (6, 6') configured as a mineral wool panel into the slot (32), and installation of a facade cladding (4) on the load-bearing structure such that the facade cladding (4) is arranged at a spaced location from the insulation layer (3), forming a rear ventilation gap (5), wherein the at least one fire barrier (6, 6') extends over the entire depth of the rear ventilation gap (5), and wherein the at least one fire barrier (6, 6') has at least one opening, which extends in the vertical direction and which comes to lie in the area of the rear ventilation gap (5).

12. Process in accordance with claim 11, characterized in that the at least one slot (32) is formed in the insulation layer (3) by a) cutting into the flatly laid insulation layer (3), wherein the insulation material is removed from the area of the slot (32); or b) installing the insulation panels (31) of the insulation layer (3) at spaced locations from one another such that the at least one slot (32) is obtained between vertically adjacent insulation panels (31).

13. Process in accordance with claim 11, characterized in that the at least one fire barrier (6, 6') is inserted into the associated slot (32) to a predetermined extent, wherein the at least one fire barrier (6, 6') is inserted through the entire insulation layer (3) up to the external wall (2).

14. Process in accordance with claim 11, characterized in that the fire barrier (6, 6') is pressed into the slot (32) or clamped between two vertically adjacent facade insulation panels (31).

15. Process in accordance with claim 11, characterized in that fire barriers (6, 6') are arranged in every floor of the building.

16. Process in accordance with claim 11 characterized in that at least the facade insulation panels (31) of a layer of facade insulation panels (31) directly above the fire barriers (6, 6') are vertically slidably secured to the external wall (2).

17. The building facade according to claim 4, wherein the sum of areas of the openings per linear meter is equal to or is less than 70 $cm^2$.

18. The building facade according to claim 5, wherein the fire barrier (6) has a thickness between about 3 cm and about 5 cm.

19. The building facade according to claim 6, wherein the fire barrier (6, 6') has an apparent density between about 80 $kg/m^3$ and about 200 $kg/m^3$.

20. The building facade according to claim 19, wherein the fire barrier (6, 6') has an apparent density between about 100 $kg/m^3$ and about 150 $kg/m^3$.

* * * * *